US009808040B2

(12) United States Patent
Burns

(10) Patent No.: US 9,808,040 B2
(45) Date of Patent: Nov. 7, 2017

(54) STRAP FASTENER

(71) Applicant: Carole Lea Burns, Seattle, WA (US)

(72) Inventor: Carole Lea Burns, Seattle, WA (US)

( * ) Notice: Subject to any disclaimer, the term of this patent is extended or adjusted under 35 U.S.C. 154(b) by 0 days.

(21) Appl. No.: 14/551,838

(22) Filed: Nov. 24, 2014

(65) Prior Publication Data

US 2016/0143380 A1 May 26, 2016

(51) Int. Cl.
*A41F 15/02* (2006.01)
*A41F 15/00* (2006.01)
*A41C 3/12* (2006.01)

(52) U.S. Cl.
CPC ..... *A41F 15/02* (2013.01); *A41C 3/12* (2013.01); *A41F 15/002* (2013.01); *Y10T 24/44274* (2015.01)

(58) Field of Classification Search
CPC .... A41F 15/02; A41F 15/002; Y10T 24/3459; Y10T 24/4088; Y10T 21/4079; Y10T 21/4014; Y10T 21/4093; Y10T 21/318; A44B 11/04; A41C 3/12
See application file for complete search history.

(56) References Cited

U.S. PATENT DOCUMENTS 1,494,680 A 5/1924 Fisk
3,214,815 A * 11/1965 Mathison ..... A44B 11/02 24/200
4,038,726 A * 8/1977 Takabayashi ..... A44B 11/06 24/169
5,212,838 A 5/1993 Davidson et al.
5,608,918 A * 3/1997 Salvaggio ..... A42B 3/08 2/421
5,722,260 A 3/1998 Mangano
6,108,875 A * 8/2000 Anscher ..... A42B 3/08 24/170
6,135,852 A 10/2000 Young
6,684,463 B1 * 2/2004 Yang ..... A41F 15/002 24/163 K
7,140,080 B2 * 11/2006 Fildan ..... A44B 11/04 24/194
7,808,386 B1 * 10/2010 Sayegh ..... E05B 73/0017 235/385
8,357,025 B2 1/2013 Brydon
8,984,723 B2 * 3/2015 Pitman ..... A41F 15/002 24/200

(Continued)

FOREIGN PATENT DOCUMENTS

WO 2007091025 A1 8/2007

OTHER PUBLICATIONS

International Search Report and Written Opinion of the International Searching Authority Mailed Mar. 8, 2016 for Application No. PCT/US2015/062268 (11 Pages).

*Primary Examiner* — Robert J Sandy
*Assistant Examiner* — Rowland Do
(74) *Attorney, Agent, or Firm* — Brown Rudnick LLP; Mark S. Leonardo

(57) ABSTRACT

Strap fasteners inhibit undesirable adjustment of garment straps, such as bra straps. The strap fasteners may have a clamshell configuration designed to encompass an adjustable portion of a bra strap to prevent movement of the bra strap or prevent movement of an adjustable element of the bra strap. In particular, strap fasteners minimize or prevent movement of a slider that controls the adjustment of a bra strap.

9 Claims, 9 Drawing Sheets

(56) References Cited

U.S. PATENT DOCUMENTS

| | | | | |
|---|---|---|---|---|
| 2002/0010986 | A1* | 1/2002 | Fildan | A41C 3/00 24/689 |
| 2003/0115727 | A1 | 6/2003 | Yokozeki et al. | |
| 2005/0039243 | A1* | 2/2005 | Henderson | A41F 1/002 2/327 |
| 2006/0286901 | A1 | 12/2006 | Cremer et al. | |
| 2009/0126084 | A1* | 5/2009 | Fenske | A41C 3/005 2/338 |
| 2011/0269376 | A1 | 11/2011 | Clim | |
| 2012/0028539 | A1 | 2/2012 | McCarty | |
| 2012/0278974 | A1 | 11/2012 | Lembo James et al. | |
| 2012/0311831 | A1 | 12/2012 | Berns et al. | |
| 2013/0029561 | A1 | 1/2013 | Lin | |
| 2014/0349550 | A1* | 11/2014 | Campbell | A41C 5/00 450/60 |
| 2015/0074873 | A1* | 3/2015 | Carleton | A41F 15/02 2/244 |

* cited by examiner

STRAP FASTENER

TECHNICAL FIELD

The present invention relates to fasteners for minimizing undesirable movement of adjustable garment straps, such as bra straps.

BACKGROUND

Brassieres, commonly known as bras, are undergarments typically worn by women under clothing to provide support to their breasts. Bras are designed to be form fitting around the chest of a wearer, and usually include a chest band that wraps around the wearer's torso, two cups that hold the breasts, and two straps that extend from the cups, over the wearer's shoulder, and attach to the back of the chest band. Bra manufacturers often size bras to fit prototypical women of a certain chest circumference and cup size, and assume that both breasts are equally sized and positioned.

Unfortunately, most women are not shaped like the prototypical women that the bras are designed to fit. In addition to varying chest sizes, women's breasts vary in volume, width, height, composition, shape, and position on the chest. As such, bras are often manufactured with adjustable straps that allow women to tailor the fit of the bra to meet their unique measurements. FIG. 1 illustrates a typical adjustable strap 2 of a bra 1. Adjustable straps 2 are formed by looping a portion of the strap through a ring 4 and then attaching an end of the strap to a slider 6 positioned on a non-looped portion 10 of the strap. The slider 6 can be moved up and down (as indicated by the arrow) the strap. That movement changes the proportion of the looped portion 8 to non-looped portion 10, thereby adjusting the length of the strap 2 and the fit of the bra 1.

Beyond fit, adjustable straps allow women to personalize the bra to meet other personal wants and needs, such as the amount of support, the amount of lift, the amount of cleavage, and the amount of restraint. While adjustable straps do have the stated advantages, the sliders of the adjustable straps often move during use, which causes unintentional and undesirable adjustment of one or both straps—to the annoyance of wearer. Thus, often women have to continually readjust their straps to maintain the fit and other desired features (i.e. lift, support, etc.). The sliders also tend to move during wash, requiring the wearers to re-adjust the sliders/straps after each wash in an effort to recreate their desired fit.

SUMMARY

The present invention provides fasteners that minimize undesirable and unintentional movement of an adjustable bra strap or other adjustable garment strap. By preventing adjustment of bra straps, fasteners of the invention advantageously maintain the wearer's desired fit of the bra. According to certain aspects, a fastener of the invention has a clamshell configuration designed to encompass an adjustable portion of a bra strap in order to prevent movement of the bra strap. Particularly, bra fasteners of the invention minimize or prevent movement of a slider that controls the adjustment of a bra strap.

According to certain embodiments, a fastener of the invention is convertible from a closed configuration, in which the fastener encompasses an adjustable portion of a bra strap, and an open configuration, in which the fastener is removable from the bra strap. In such aspects, the fastener includes a first plate and a second plate coupled together by a joint. The plates may be shaped like discs. The first plate includes an inner surface, a clasp member, and a plurality of protrusions on the inner surface. The second plate is coupled to the first plate and includes an inner surface and a clasp member. The fastener, when in the closed configuration, is configured such that the inner surface of the first plate is separated from and faces the inner surface of the second plate and that the clasp members of the plates couple to each other. The fastener, when in the open configuration, is configured such that the first clasp member is separated from the second clasp member by a distance. This allows the bra strap to be removed from the fastener.

When in the closed configuration, the protrusions of the first plate compress against the bra strap to inhibit movement of the bra strap. In addition to the first plate's protrusions, the second plate may also have protrusions. In some embodiments, the protrusions are a plurality of tines. The protrusions may be coupled to the inner surfaces of the first or second plates, or the protrusions may be formed by cutting the material of the first or second plates.

The joint coupling the first plate and the second plate together allows the fastener to transition from the closed configuration to the open configuration. In certain embodiments, the joint causes the first and second plates to swivel when transitioning from the open to closed configurations. Any joint is suitable for use in fasteners of the invention. Preferably, the joint used automatically reverts the fastener to a resting or normal position. For example, the joint may be formed from a spring-steel or shape memory polymer. In some embodiments, the joint may be a hinge. Suitable hinges include butt hinges, butterfly hinges, flush hinges, and barrel hinges.

In some aspects, fasteners of the invention include a friction element on an outer surface of one or both plates. The friction element enhances the user's ability to open and close the fastener with their fingertips. The friction element may be an embellishment, e.g., for fashion purposes.

DETAILED DESCRIPTION

The present invention provides bra fasteners that minimize undesirable and unintentional movement of an adjustable bra strap or other adjustable garment strap. Particularly, bra fasteners of the invention minimize or prevent movement of a slider that controls adjustment of a bra strap. The slider frequently and unintentionally adjusts the bra strap because the slider has a tendency to move in response to a bra wearer's normal activity as well as gravity. According to certain aspects, a bra fastener of the invention has a clamshell configuration designed to encompass a portion of a bra strap in order to prevent movement of the bra strap. In certain embodiments, the bra fastener is positioned directly below the slider, thereby preventing movement of the slider and thus movement of the bra strap. Additionally, bra fasteners of the invention can be positioned on a portion of the bra strap prone to adjustment (such as the adjustable looped portion of the bra strap), and the snug fit and/or friction of the fastener will stop adjustment of the bra strap.

In addition to bras, fasteners of the invention may be used with other garments with adjustable straps, e.g., tank tops, bikinis, dresses, night gowns, camisoles, etc. As such, it is understood that the dimensions of the fasteners adapted to fit the adjustable straps of various garments and of various sizes.

Figure 1:
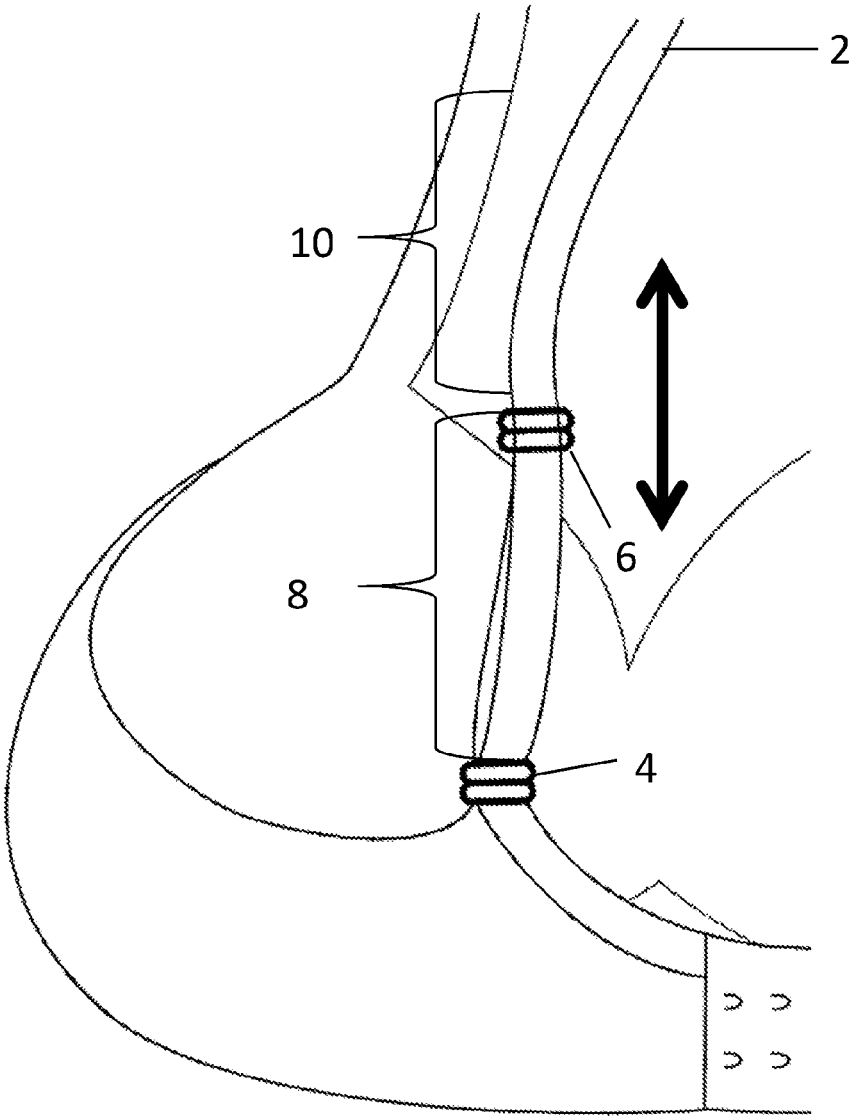
FIG. 1 PRIOR ART
FIG. 1 illustrates a typical adjustable strap of a bra.
Figure 2:
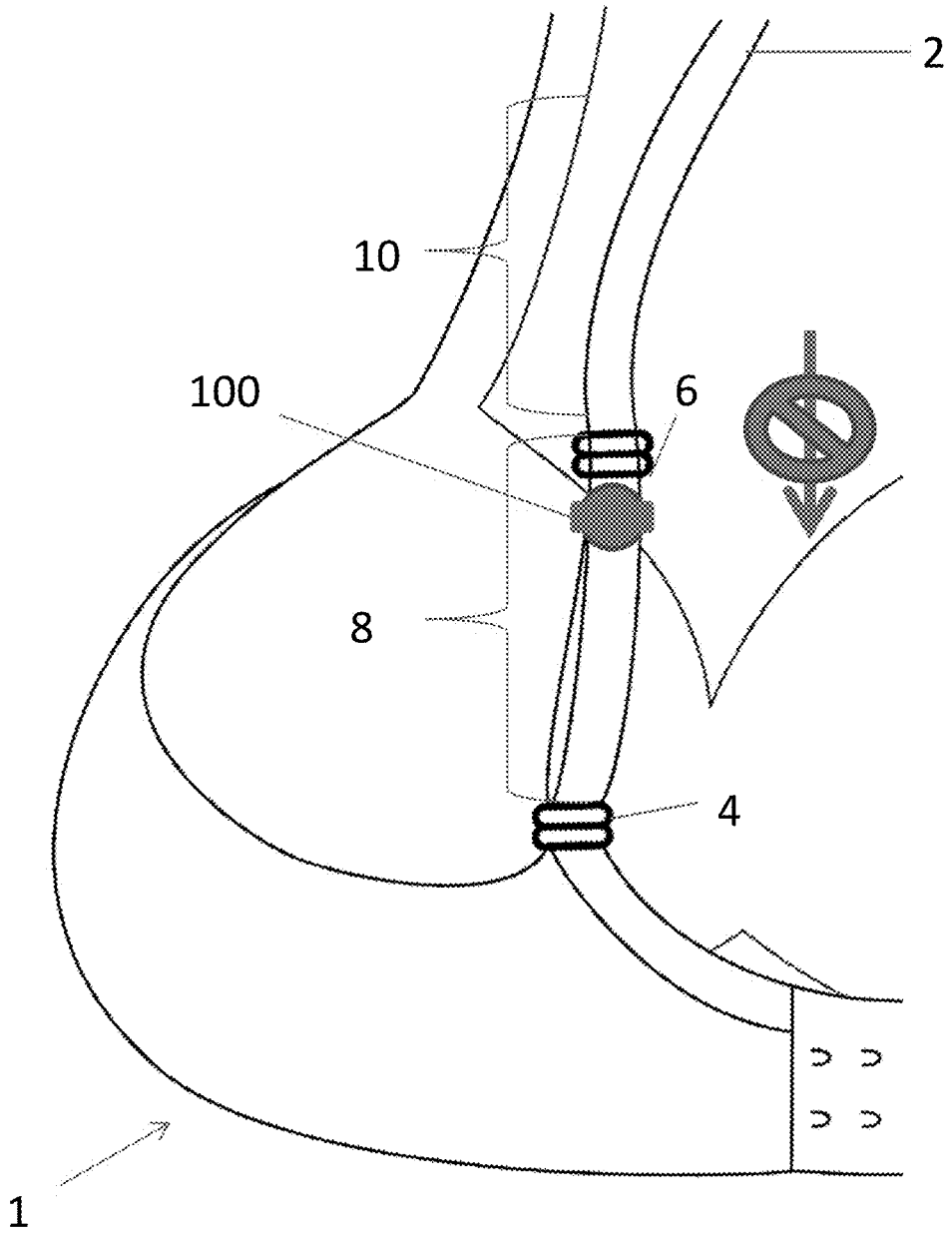
FIG. 2 illustrates a bra fastener of the invention as used to inhibit adjustment/movement of a bra strap, according to certain embodiments.

FIG. 2 illustrates a fastener of the invention as used to minimize undesirable movement of an adjustable strap. The fastener 100 may be convertible from a closed configuration, in which the fastener 100 is clamped onto and encompassing a bra strap 2 (as shown in FIG. 2), to an open configuration, in which the fastener 100 may be removed from or relocated on the bra strap. 2. The fastener 100 can be placed onto and removed from the bra strap as desired by the user. The bra fastener 100 clamps onto the strap 2, thereby encompassing a portion of the strap 2. The bra fastener 100 may be positioned below the slider 6 to stop downward movement of the slider 6. Additionally, the bra fastener 100 may be positioned above the slider 6 to stop upward movement of the slider 6. The downward/upward movement if not prevented would cause the strap 2 to unintentionally and undesirably adjust. As shown, the fastener 100 is also positioned on an adjustable portion of the strap 2. This positioning also acts to minimize unintentional and undesirable adjustment of the strap 2. Typically, the adjustable portion of a strap 2 is the portion of the strap that is looped (i.e. looped portion 8). In some embodiments, the tight fit of the fastener 100 around the strap 2 minimizes movement of the adjustable portion. In other embodiments, the fastener 100 may include internal surface elements to minimize or prevent movement of the adjustable portion (discussed in more detail hereinafter). In certain embodiments, the fastener 100 minimizes adjustment of the bra strap due to a tight fit and surface elements.

Figure 3A:
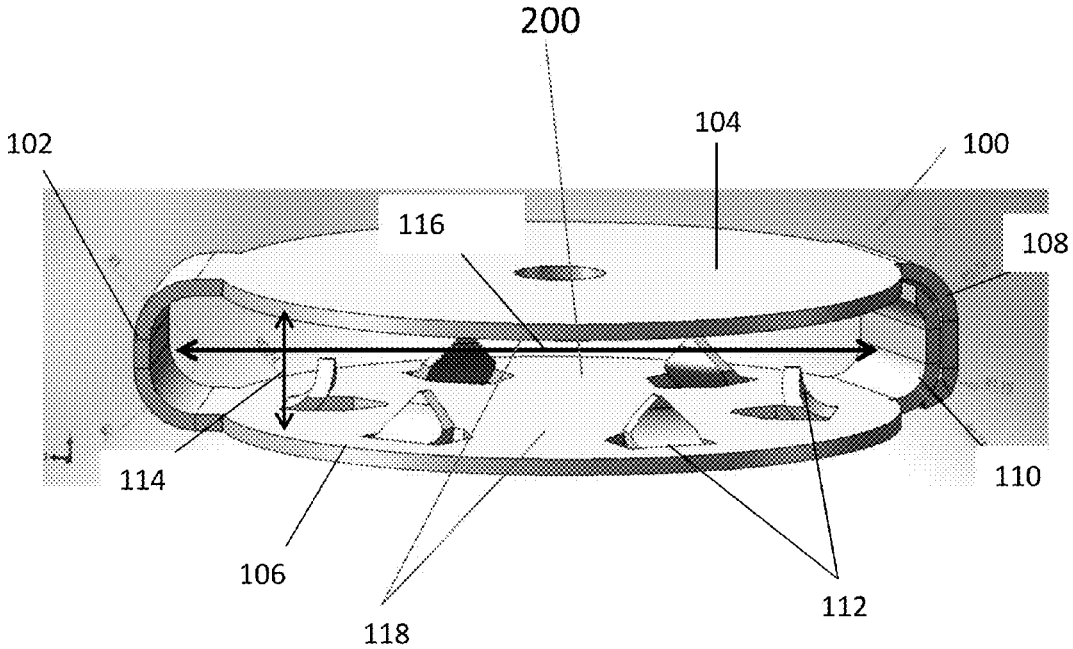
FIG. 3A illustrates a bra fastener of the invention in the closed configuration.
Figure 3B:
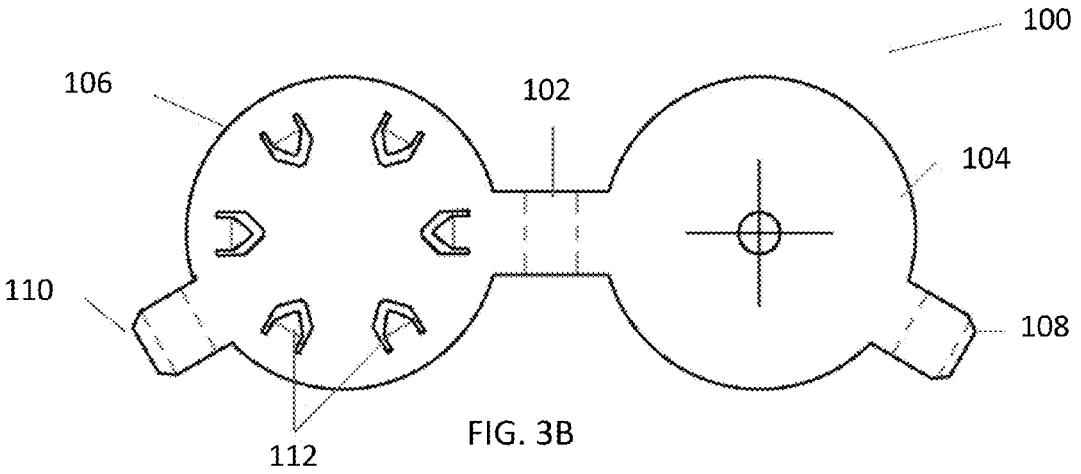
FIG. 3B illustrates the bra fastener of FIG. 3A in a laid-out assembly configuration.
Figure 3C:
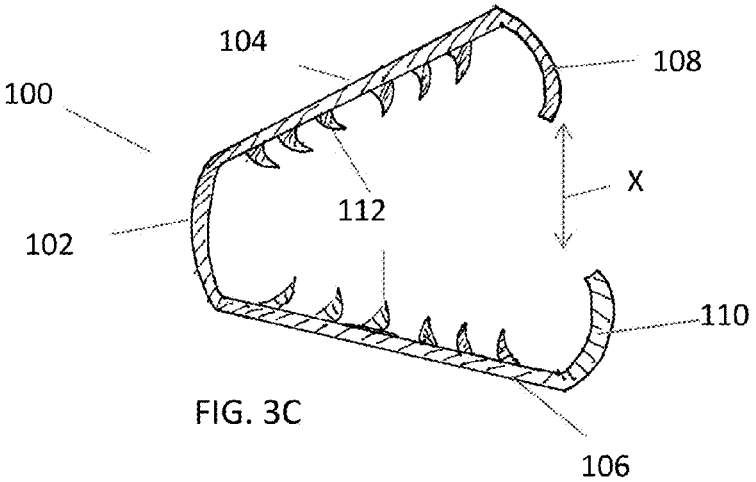
FIG. 3C illustrates the bra fastener of FIG. 3A in an open configuration.

FIGS. 3A-3C provide a detailed view a fastener of the invention according to certain embodiments. FIG. 3A depicts the fastener 100 in a closed configuration, which is the configuration of the fastener when positioned onto a strap to minimize adjustment of the strap 2. The fastener 100 includes two plates 104, 106 coupled by a joint 102. The plates 104, 106 may be any shape, including round, rectangular, oval, etc. In certain embodiments, the plates 104, 106 are discs. The plates 104, 106 may be flat or may be curved to rest against the body of the bra wearer. The plates 104, 106 may also vary in rigidity. In certain embodiments, the plates 104, 106 may be flexible to conform against the body of the bra wearer. Alternatively, the plates 104, 106 may be rigid. The features (shape, material, size, rigidity, etc.) of plate 104 may be the same as or different from that of plate 106. Each plate 104, 106 may include a clasp member 108, 110. The clasp members 108, 110 are configured to mate and releasably join or lock the fastener in the closed configuration around the bra strap. Any mate-fit known in the art can be used to releasably join the clasp members 108, 110 together. In certain embodiments, the clasp members 108, 110 extend from an outer edge of the plates 104, 106. In some embodiments, the clasp members 108, 110 are positioned opposite or substantially opposite from the joint 102 that couples the plates together. FIG. 3C shows a fastener in an open configuration, in which clasp members 108, 110 are separated by distance X.

The joint 102 allows a degree of rotation, swivel or other movement of the plates 104, 106 such that the plates 104, 106 can transition from the open configuration to the closed configuration. In some embodiments, the joint 102 extends from an outer edge of the plates 104, 106. Any joint 102 is suitable to couple and allow movement of the plates 104, 106. In preferred embodiments, the joint 102 automatically returns the fastener 100 to the closed configuration or returns substantially to the closed configuration after opening. In such embodiments, the joint 102 may be formed from a spring-steel or a shape-memory polymer. Preferably, the joint 102 is the spring-steel joint. A spring-steel joint ensures resilience, while also allowing the fastener to bend back to its original shape. In additional embodiments, the joint 102 is a hinge. Suitable hinges include, for example, a butt hinge, a butterfly hinge, a flush hinge, or a barrel hinge.

Figure 9:
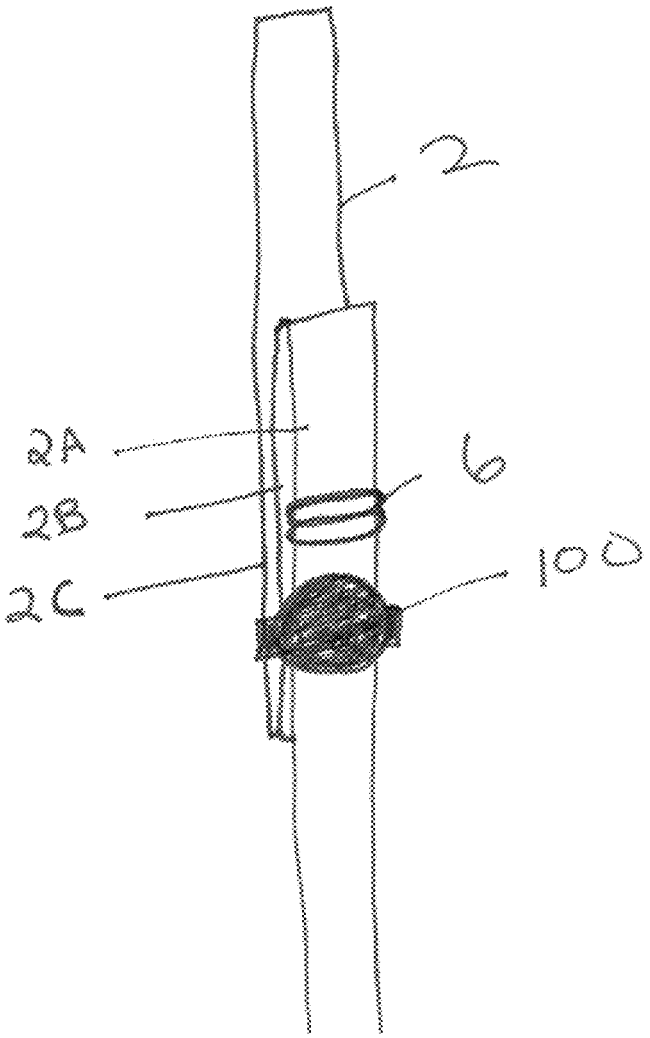
FIG. 9 depicts a fastener of the invention used with a strap that is folded over itself.

According to certain aspects, the fastener 100 is designed to form a tight or snug fit around a bra strap 2. That is, the internal space 200 of the fastener is substantially similar to a cross-section of the bra strap 2. In certain embodiments, the internal space 200, formed by the fastener 100 when in the closed configuration, has an internal width 116 and an internal height 114. In certain embodiments, the internal width 116 of the fastener 100 is less than ¼", ⅜", ½", ⅝", etc. In certain embodiments, the internal height 114 of the fastener 100 is less than 1/12", 2/12", 3/12", ½", etc. In further embodiments, the fastener 200 is configured such that the fastener is able to encompass the width of two or more straps. For example, the internal space 200 of the fastener is dimensioned to encompass a bra strap and a camisole strap at the same time. In another example, the fastener is dimensioned to encompass a strap that is folded over itself one or more times, as shown in FIG. 9. FIG. 9 depicts a strap 2 that is folded over itself, in which the folded portion is the width of three straps (e.g, layer 2A, layer 2B, layer 2C of strap 2). The fastener 100 is dimensioned to encompass all three layers 2A, 2B, and 2C of strap 2. A benefit of closing the fastener onto a folded strap is that the fastener 100 then allows the strap to achieve a shorter length that is otherwise not possible. Advantageous reasons for shortening the bra strap with the fastener include: shortening the strap to provide better lift; shortening the strap to compensate for bra straps that have lost elasticity (e.g., due to usage and washing); shortening the strap to prevent the strap from sliding off a shoulder of the wearer; etc.

Figure 10:
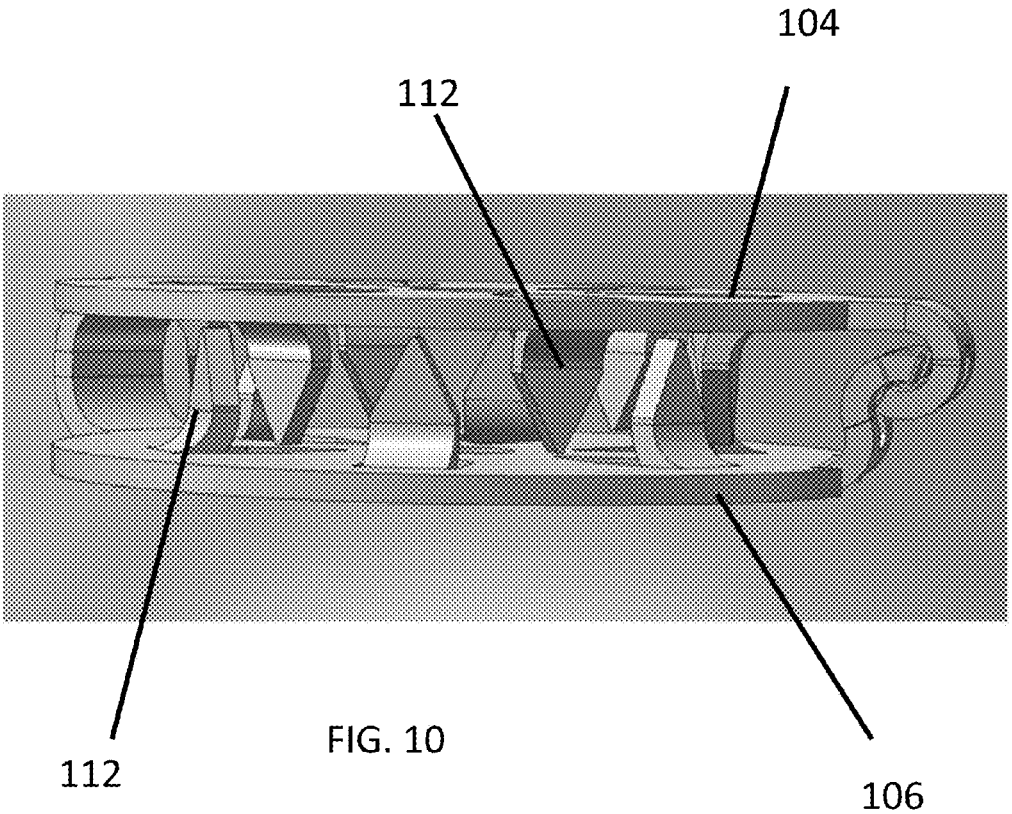
FIG. 10 illustrates another bra fastener of the invention in the closed configuration.

When the fastener 100 is in the closed configuration, the inner surface 116 of plate 104 faces the inner surface 118 of plate 106. When the fastener 100 is in use, the inner surfaces 116, 118 may rest against the strap 2 disposed therein. In certain embodiments, inner surface 116, inner surface 118, or both may include a surface element 112 configured to inhibit movement of the bra strap 2 when the fastener 100 is clamped onto the bra strap 2. FIGS. 3A-3B illustrate surface elements 112 on one plate, whereas FIG. 3C illustrates surfaces elements 112 on both plates. FIG. 10 illustrates surface elements 112 interspersed on the inner surfaces of plates 104 and 106. The surface elements 112 of plate 104 and surface elements 112 of plate 106 may face the same and/or opposing directions when the plates are in the closed configuration.

The surface element 112 may be anything that causes friction between the fastener 100 and the bra strap 2. In certain embodiments, the surface element 112 comprises one or more protrusions. The protrusions may be tines. In some embodiments, the surface element 112 is coupled to the plates 104, 106. Alternatively, the surface elements 112 may be formed from the materials of the plates 104, 106. For example, the plates 104, 106 may be cut and the cut portions of the plates 106, 104 may be elevated on the inner surfaces 118 to form the surface elements. The fasteners of FIGS. 3A-3C illustrate surface elements that are cut directly onto the plates 104, 106. To form the surface elements 112 directly from the plate, the plates may be stamped, laser-cut, or mechanically cut.

In certain embodiments, the surface elements 112 act to catch the material of the bra strap when the fastener 100 is clamped onto the strap. The fastener 100 with the surface element 112 is able to firmly grip onto the strap and minimize/prevent movement of the strap and the slider. Preferably, the surface elements 112 minimize movement without damaging the strap.

In certain embodiments, the fastener 100 may be formed from a unitary piece of material. The advantage of this is that the fastener 100 can be easily cut into the flat blank shown in FIG. 3B using known techniques, and then bent into the desired fastener configuration. Alternatively, the fastener 100 may be formed from two or more separate components that are joined or melded together. For example, one or more of the plates 104, 106, joint 102, surface elements 112, and clasp members 108, 110 may be separate components that are joined or melded together to form the fastener 100.

Unitary or multi-component fasteners of the invention may be formed using conventional techniques. The techniques may include laser cutting, mechanical cutting, 3D printing, stamping, filing, deburring, electroplating, tooling, etc.

Figure 4A:
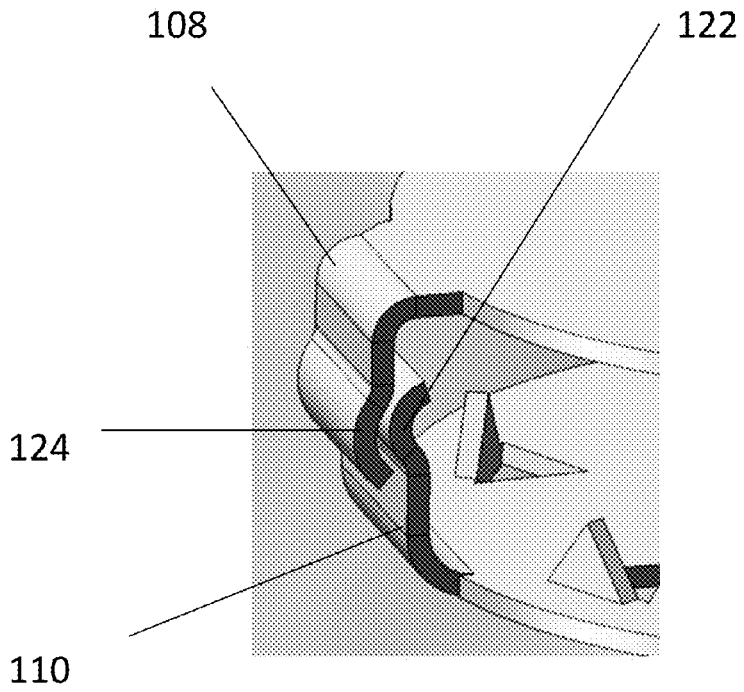
FIG. 4A illustrates a clasping mechanism of fasteners of the invention.
Figure 4B:
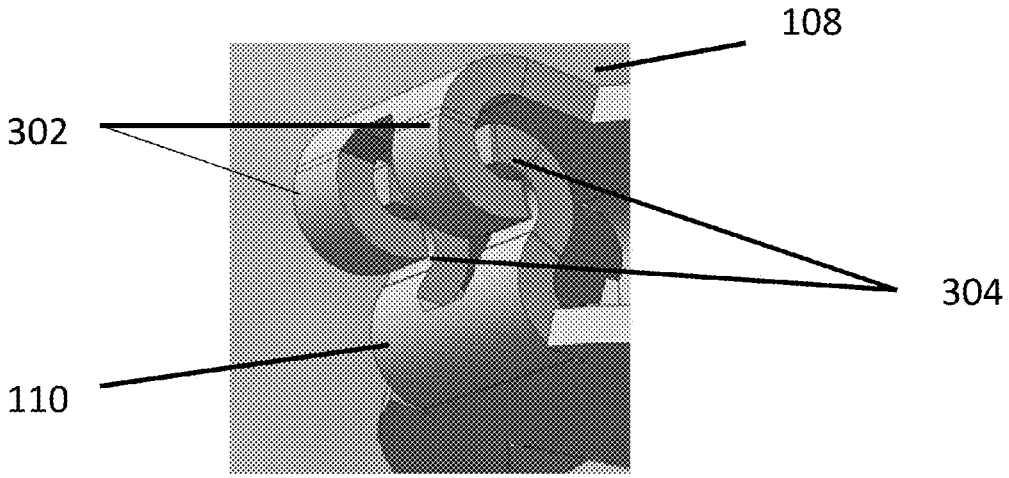
FIG. 4B illustrates another clasping mechanism of fasteners of the invention.

FIG. 4A provides a close-up view of the clasp members 108, 110, as clasped together to lock the fastener 100 in the closed configuration. As shown in FIG. 4A, the clasp members 108, 110 are coupled together via mate-fit indentions 122, 124. In order to close the fastener 100, a user applies pressure to plates 104, 106. The pressure causes clasp member 108 to slide over clasp member 110 until the indentions 122, 124 engage with each other. The clasp members 108, 110 are of sufficient rigidity such that the clasp members remain in the locked position due to the mating of the indentions 122, 124. Pressure can be applied to unlock the clasp members 108, 110 (e.g., by applying upward pressure on the outer clasp member). As an alternative to the clasp members with mate-fit indentations as shown in FIG. 4, it is understood that the clasp members 108, 110 can be designed with another configuration that allow the clasp members 108, 110 to releasably couple to each other and lock the fastener 100 in the closed position. In other embodiments, the clasp members 108, 110 may include two or more hook elements 302, 304. When pressed together, the hook elements 302 of clasp member 108 and hook elements 304 of clasp member 110 mate-fit with each other such that the hook elements 302, 304 link together as shown in FIG. 4B.

Figure 5:
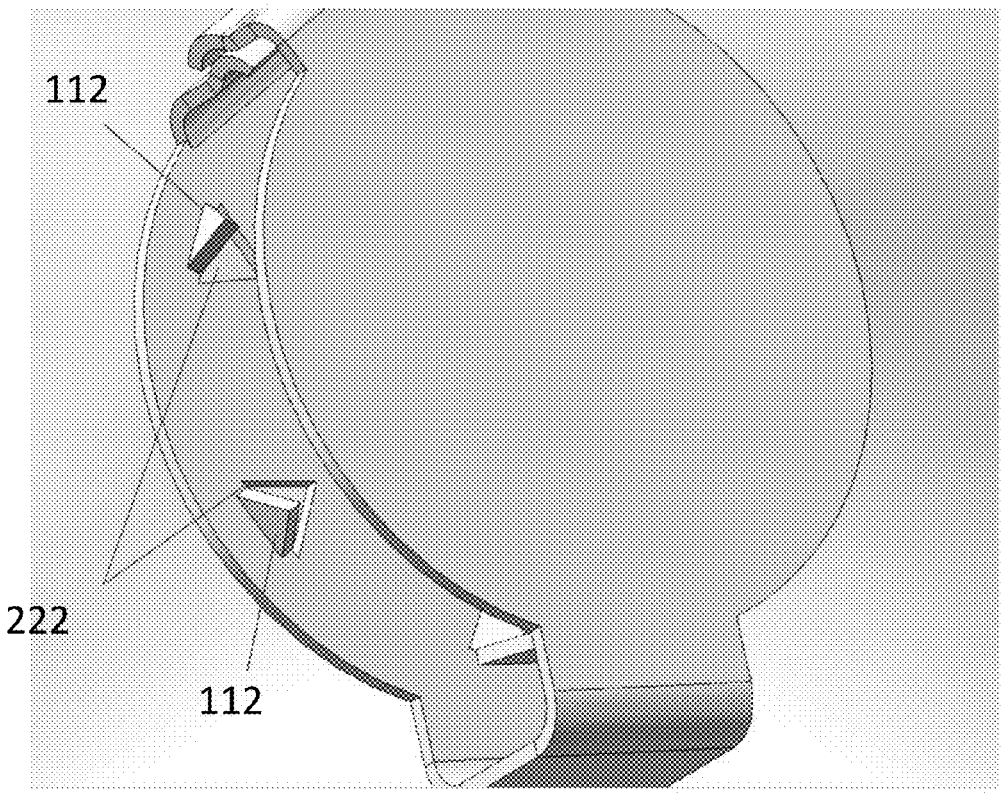
FIG. 5 illustrates a friction element of fasteners of the invention.

In certain aspects, one or both of the outer surfaces of plates 104, 106 of the fastener 104 may include a friction element. The friction element is designed to ease a user's ability to close and open the fastener. In certain embodiments, the friction element may be a treatment applied to the outer surface, e.g., application of ridges, bumps, or the like. In other embodiments, the friction element may be an object adhered to the outer surfaces of the plates 104, 106. The object may be a decorative embellishment. In further embodiments and as shown in FIG. 5, the friction element may be the openings 222 formed on the outer surface of the plate 104, 106 due to the formation of the inner surface protrusions 112.

According to particular aspects, at least one outer surface of the fastener includes an embellishment. For example, it is now common for some individuals to expose the bra straps and some garments (such as camisoles) are designed to have the adjustable straps shown. The embellishment may include any design such as those with flowers, plants, animals, letters, and numbers. The embellishment may include gems or be designed to look like jewelry, giving a higher quality and decorative appearance to the outfit. With embellishments, the fastener is fashionable while ensuring an uplifting and secure fit at the same time. The embellishment may be affixed to the outer surface or the embellishment may be removably coupled to the outer surface. Removable embellishments may be interchanged to fit the particular fashion of the wearer. In one embodiment, the outer surface includes a male mate-fit element that would mate with a female mate-fit element of an embellishment (e.g., via a snap-fit).

The fastener may be formed from a variety of materials, e.g. metals, plastics, combinations thereof. The fastener may be formed from metals and metal alloys, such as aluminum, stainless steel, gold, brass, silver, alloys thereof, combinations thereof, The fastener may include plastics or polymers, such as Polyethylene terephthalate (PET), Polyethylene (PE), High-density polyethylene (HDPE), Polyvinyl chloride (PVC), Polyvinylidene chloride (PVDC) Low-density polyethylene (LDPE), Polypropylene (PP), Polystyrene (PS), High impact polystyrene (HIPS), combinations thereof, etc. Preferably, the material allows for easy and inexpensive manufacture.

In preferred embodiments, the fastener is formed from a material that is machine washable. This allows the fastener to maintain the desired fit of the user after wash. As such, the user advantageously does not have to readjust the bar after every wash and reapply the fastener.

Figure 6:
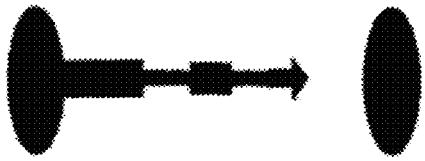
FIG. 6 illustrates a fastener of the invention according to a certain embodiment.
Figure 7:
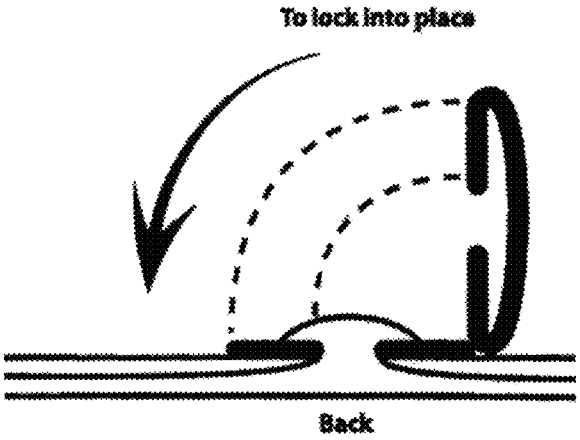
FIG. 7 illustrates a fastener of the invention according to another embodiment.
Figure 8:
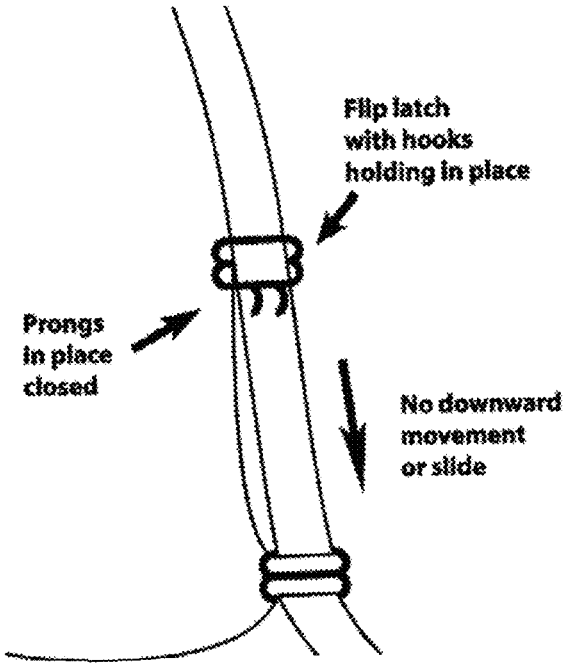
FIG. 8 illustrates a fastener of the invention according to yet another embodiment.

FIGS. 6-8 illustrate alternative embodiments of fasteners of the invention. The fastener of FIG. 6 has a press-pin configuration. The press-pin fastener includes a first member with a piecing element. The piercing element of the first member can be pressed through the bra strap. A second locking member can then be attached to the piercing element, thereby locking the press-pin on the strap. The locking member may attach to the piercing element via a screw configuration or a mate-fit configuration. The fasteners of FIGS. 7 and 8 are associated with the slider of the bra strap itself. As shown in FIG. 7, the slider may include press member that, when pressed down, applies pressure to the portion of the bra strap that is threaded through the slider and prevents movement of the slider relative to the bra strap. As shown in FIG. 8, the slider may include one or more hooks. When the hooks are pressed down, the hooks engage with the bra strap and prevent movement of the slider.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A fastener assembly for minimizing movement of a bra strap, the fastener comprising:

a flat disc-shaped first plate comprising a first outer surface, a first inner surface, a first clasp member, and a plurality of protrusions on the first inner surface; and a flat disc-shaped second plate coupled to the first plate and comprising a second outer surface, a second inner surface and a second clasp member;

wherein the fastener is convertible between:

(i) a closed configuration wherein the first inner surface of the first plate faces, and is separated from, the second inner surface of the second plate and the first clasp member releasably couples to the second clasp member such that the fastener is configured to encompass two opposing sides of a looped-portion of a bra strap disposed between the first and second inner surfaces of the first and second plates, respectively, wherein one of the two opposing sides of the looped-portion of the bra strap is in contact with the plurality of protrusions; and (ii) an open configuration, in which the first clasp member is uncoupled from the second clasp member such that the fastener is configured to release the two opposing sides of the looped-portion of the bra strap;

wherein the second plate coupled to the first plate via a joint comprising spring-steel or a shape memory material configured to automatically return to a default shape, wherein the default shape results in the fastener automatically transitioning from either the open configuration to the closed configuration or from the closed configuration to the open configuration; and wherein the first outer surface of the first plate comprises a mounting portion configured to engage and retain one of a plurality of interchangeable embellishment members thereto, the mounting portion and interchangeable embellishment member are configured to matingly engage one another via a releasable coupling, wherein at least one of the mounting portion and interchangeable embellishment member comprises a male element and the other comprises a corresponding female element.

2. The fastener of claim 1, wherein the second plate also comprises a plurality of protrusions.

3. The fastener of claim 1, wherein the material of the first plate is cut or stamped to form the plurality of protrusions on the inner surface.

4. The fastener of claim 1, wherein the outer surface of the first plate comprises a friction element configured to provide a user with an enhanced gripping portion when converting the fastener between the closed and open configurations.

5. The fastener of claim 1, wherein the first plate, second plate, and joint are formed from a unitary piece of material.

6. The fastener of claim 1, wherein the first and second clasp members, when the fastener is in the closed configuration, substantially oppose the joint.

7. The fastener of claim 1, wherein the fastener is formed from a metal or a polymer.

8. The fastener of claim 7, wherein the metal is a stainless steel.

9. The fastener of claim 1, wherein the fastener has an inner width selected from the group consisting of ⅜", ½", and ⅝".

* * * * *